United States Patent [19]

Bruhn

[11] Patent Number: 4,844,020

[45] Date of Patent: Jul. 4, 1989

[54] WASTE HEAT RECOVERY SYSTEM

[75] Inventor: Alfred Bruhn, Eastchester, N.Y.

[73] Assignee: American Hydrotherm Corp., New York, N.Y.

[21] Appl. No.: 168,421

[22] Filed: Mar. 15, 1988

[51] Int. Cl.[4] ..... F22B 1/18; F28D 15/00

[52] U.S. Cl. ..... 122/7 R; 122/32; 165/104.13; 165/104.31; 165/909; 237/1 SL

[58] Field of Search ..... 165/909, 104.31, 104.13; 237/1 SL; 122/7 R, 32, 33

[56] References Cited

U.S. PATENT DOCUMENTS 1,833,130 11/1931 Roe ..... 165/909

4,016,066 4/1977 Shiraiwa et al. ..... 122/7 R 4,257,579 3/1981 Bruhn et al. ..... 165/909

4,340,207 7/1982 Bruhn et al. ..... 165/909

*Primary Examiner*—Albert W. Davis, Jr.

*Attorney, Agent, or Firm*—Louis E. Marn

[57] ABSTRACT

There is disclosed a heat recovery system for recovering the heat potential of a gaseous stream having a temperature of from 500° to 2500° F. utilizing a primary heat exchanger through which is passed a heat transfer salt mixture in indirect heat transfer relationship with the hot gaseous stream to recover the heat potential to use such primary heat transfer salt mixture in a plurality of serially arrayed heat exchangers as a heating medium for diverse fluids at descending temperature levels.

9 Claims, 1 Drawing Sheet

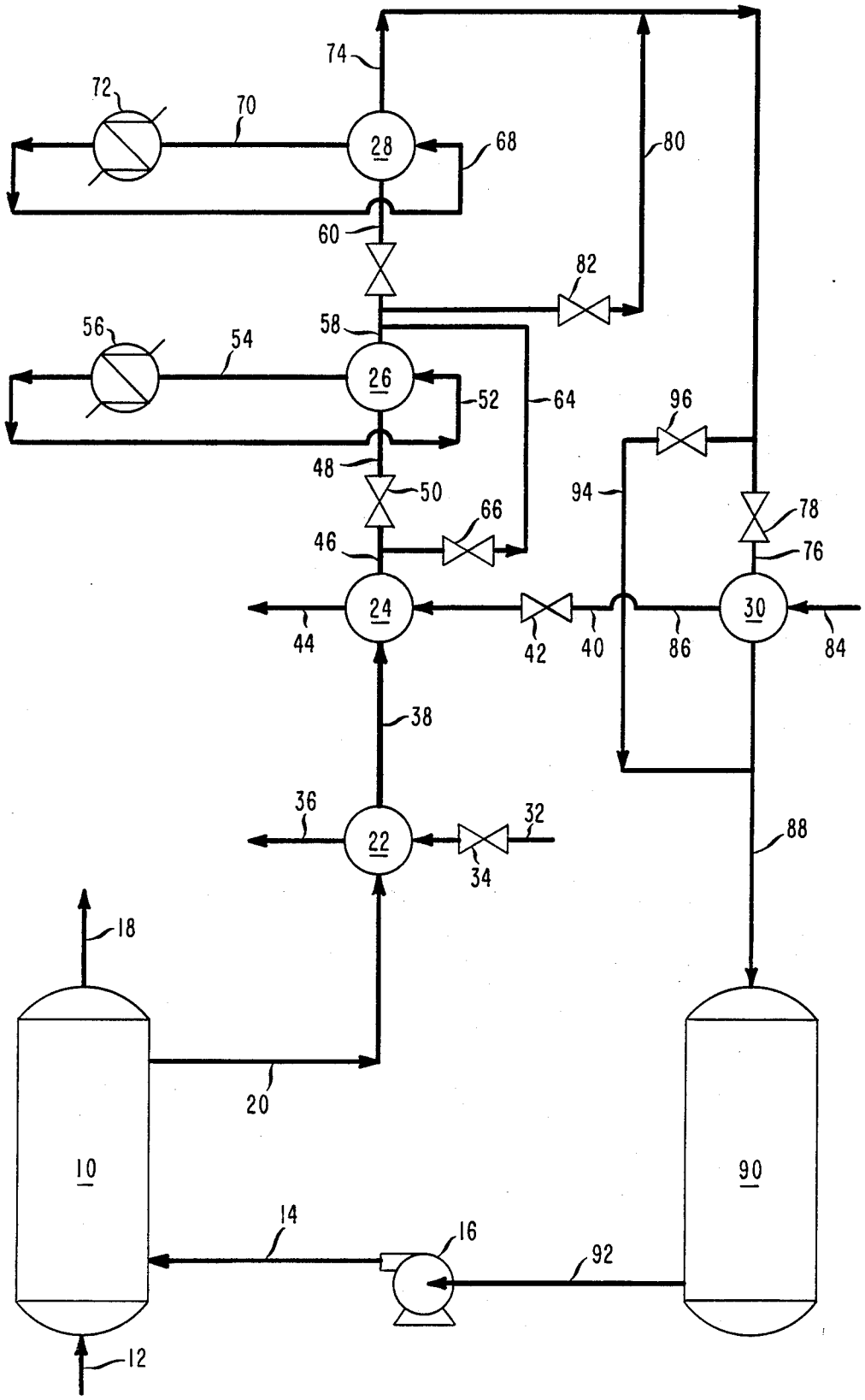
74
72
70
28
68
80
60
82
56
58
54
26
52
64
96
48
50
94
78
66
46
76
24
30
44
42
40
86
84
38
36
32
22
34
88
18
20
10
90
14
16
92
12

WASTE HEAT RECOVERY SYSTEM

BACKGROUND OF THE INVENTION (1) Field of the Invention

This invention relates to the recovery of waste heat, and more particularly to an apparatus for the recovery of heat from high temperature gaseous streams.

(2) Description of the Prior Art

Cogeneration and heat recovery systems normally recover heat from hot gases leaving a gas turbine, gas engine, or other source of hot gas by generating steam which is used for process or space heating, for driving a steam turbine and generating electricity or for driving a pump or compressor. Infrequently, a high temperature hot oil stream is used to recover heat and transfer the heat to other streams via heat exchangers.

A frequent application of heat recovery systems is one in which hot gases leaving a gas turbine in the range of 800° to 950° F. produces power at a steady rate which is sold to a local power company, split between the power company and operating company or used by the operating company. Generally, there is an excess of heat available or the heat uses vary depending on plant operation, and therefore, some of the hot gases by-pass the heat recovery system via expensive and somewhat unreliable large by-pass stack damper. An expensive and complex control system is required to automatically modulate the opening of such damper, and in the case of failure of the by-pass system, steam pressure will rise to elevated pressures and/or the heat transfer oil will rise to an elevated temperature requiring automatic shutdown of the gas turbine or the source of the hot gases.

In a hot oil recovery unit, heat transfer design is very complex and expensive because oil will break down if its maximum film temperature (730° to 800° F.) is exceeded due to oil flow interruptions, gas flow interruptions or overfiring. Therefore, the capital cost is high as is operating cost to replace or replenish the heat transfer oil.

In U.S. Pat. No. 4,257,579 to Bruhn et al and assigned to the same assignee as the present invention, there is disclosed a waste heat recovery system using at least two heat exchange recovery systems utilizing intermediate heat transfer mediums for a process operation producing an exhaust or waste gas at temperatures of from 500° to 2500° F. wherein the heat exchanges unit may be fabricated using conventional materials of construction and wherein heat may be recovered at levels substantially higher than with the use of a single intermediate heat transfer medium, however, such systems depend upon using two or more heat recovery systems and each system has to have the ability to fully use all the heat that is recovered in each system.

OBJECTS OF THE PRESENT INVENTION

It is an object of the present invention to provide an improved apparatus for recovering heat from a high temperature gaseous stream.

Another object of the present invention to provide an improved apparatus for recovering heat from a high temperature gaseous stream obviating any by-pass dampers requirements for balancing user requirements.

Still another object of the present invention to provide an improved apparatus for recovering heat from a high temperature gaseous stream at reduced capital costs.

Yet another object of the present invention to provide an improved apparatus for recovering heat from a high temperature gaseous stream of greater reliability.

SUMMARY OF THE INVENTION

These and other objects of the present invention are achieved in a heat recovery system utilizing a primary heat transfer salt mixture to recover heat from the exhaust or waste gas at a temperature of from 500° to 2500° F., and to use such primary heat transfer salt mixture in a plurality of serially arrayed heat exchangers as a heating medium for diverse fluids at descending temperature levels.

BRIEF DESCRIPTION OF THE DRAWING

The invention will be more clearly understood by reference to the following description of an exemplary embodiment thereof when taken in conjunction with the accompanying drawing illustrating a schematic flow diagram thereof.

DETAIL DESCRIPTION OF THE INVENTION

Referring now to the drawing, there is illustrated a primary heat exchanger 10 for introducing by line 12 a hot gaseous stream at a temperature of from 800° to 1000° F. to be passed in indirect heat transfer relationship to a heat transfer salt mixture introduced through line 14 by pump 16 into the primary heat exchanger 10 to recover the heat potential of the hot gaseous stream in line 12. After recovery of the heat potential by the salt mixture in the heat exchanger 10, a residual gaseous stream is withdrawn by line 18 from the heat exchanger 10 and vented to the atmosphere or passed to a low temperature heat recovery system (not shown) which generates steam. The thus heated heat transfer salt mixture at a temperature of from 700° to 900° F. is withdrawn by line 20 from the heat exchanger 10 and is serially passed through heat exchangers 22, 24, 26, 28 and 30 for heating process streams therein at diverse temperature levels, as more fully hereafter discussed.

In heat exchanger 22, the heated heat transfer salt mixture in line 20 is passed in indirect heat transfer relationship with a first process fluid, such as low pressure stream (150 psig) introduced by line 32 under the control of valve 34. The process fluid, such as low pressure steam is heated to a higher temperature level of from 650° to 700° F. and is withdrawn by line 36 and passed to an in plant unit (not shown). The heat transfer salt mixture at a lower temperature level of from 698° to 898° F. is withdrawn by line 38 from the heat exchanger 22 and passed to the heat exchanger 24 to be passed in indirect heat transfer relationship to a second process fluid, such as high pressure stream introduced by line 40 under the control of valve 42. The second process fluid is heated to a temperature level of from 640° to 690° F., and withdrawn by line 44 from the heat exchanger 24 and passed to an in plant unit process (not shown).

The heat transfer salt mixture at a lower temperature level is withdrawn by line 46 from the heat exchanger 24 and passed by line 48 under the control of valve 50 to the heat exchanger 26 to be passed in indirect heat transfer relationship to a third fluid, such as a heat transfer oil introduced by line 52. The third process fluid is heated to a higher temperature level of from 690° to 700° F., and withdrawn by line 54 from the heat exchanger 26 and passed to a heat exchanger 56 to provide the heating requirements for a process fluid, such as crude oil, and recycled to the heat exchanger 26.

The heat transfer salt mixture at a still lower temperature level is withdrawn by line 58 from the heat exchanger 26 and is passed by line 60 under the control valve 62 to the heat exchanger 28. All or a portion of the heat transfer salt mixture in line 46 may be caused to by-pass the heat exchanger 26 by passing such heat transfer salt mixture through line 64 under the control of valve 66 and combining same with the heat transfer salt mixture, if any in line 58 to form the heat transfer salt mixture in line 60.

The heat transfer salt mixture in line 60 introduced into the heat exchanger 28 is passed in indirect heat transfer relationship to a fourth fluid, such as a heat transfer oil in line 68 and is heated to a higher temperature level of from 490° to 500° F. The thus heated fourth fluid is withdrawn by line 70 from the heat exchanger 28 and is passed to a heat exchanger 72 to provide the heat requirements for a process fluid, such as an asphalt stream, and recycled to the heat exchanger 28. The heat transfer salt mixture at a still further lower temperature level is withdrawn by line 74 from the heat exchanger 28 and is passed by line 76 under the control of valve 78 to the heat exchanger 30. All or a portion of the heat transfer salt mixture in line 58 may be caused to by-pass the heat exchanger 28 by passing such heat transfer salt mixture withdrawn from heat exchanger 26 through line 80 under the control of valve 82 and combined same with the heat transfer salt mixture in line 74 for passage to the heat exchanger 30.

The heat transfer salt mixture in line 76 introduced into the heat exchanger 30 is passed in indirect heat transfer relationship to a fifth process fluid, such as high pressure feed water in line 84 and heated to form a stream at temperature level of from 470° to 490° F. The thus heated fifth process fluid is withdrawn by line 86 from the heat exchanger 30 and passed to heat exchanger 24 in line 40 under the control of valve 42 as the source of steam. The heat transfer salt mixture at still a lower temperature level of from 550° to 650° F. is withdrawn from heat exchanger 30 by line 88 and passed to heat transfer salt mixture surge tank 90 connected by line 92 to the suction side of pump 16 for cycling through the apparatus of the present invention.

Depending on plant requirements for heated process fluids at predetermined temperature levels and flow rates, all or a portion of the heat transfer salt mixture in line 76 may be caused to by-pass the heat exchanger 30 by passing such heat transfer salt mixture by line 94 under the control of valve 96 to be combined in line 88 with any heat transfer salt mixture therein for introduced into the surge tank 90.

Assuming that the total heat potential of the gaseous stream in line 12 is removed in the heat exchanger 10 is totally distributed to the process streams passing through the heat exchangers 22 to 30, the temperature level of the heat transfer salt mixture in the surge tank 90 will remain constant, however, a decrease or increase in heat requirements of the process fluids will cause the temperature level of the heat transfer salt mixture in the surge tank 90 to be raised or lowered, respectively, as will be understood by one skilled in the art. In accordance with the present invention, the heat potential of the gaseous stream in line 12 may be recovered permitting venting of a thus cooled exhaust gas while using and/or storing the heat potential for usage as required by the process units provided with the heated fluids in lines 36, 44, 54, 70 and 80 from the heat exchangers 22, 24, 26, 28 and 30, respectively. When the heat removed in heat exchangers 22, 24, 26 and 28 is less than the heat given up by heat exchanger 10, the heat is balanced by the heat removed in heat exchanger 30 by generating high pressure steam. When the heat removed in heat exchangers 22, 24, 26 and 28 is more than the heat available in heat exchanger 10, the heat is balanced by auxiliary firing heat exchanger 10, and therefore heating the inlet gas stream in line 12.

EXAMPLES OF THE INVENTIONS

Operation of the apparatus of the present invention is illustrated in the following example which is intended to be merely illustrative and the invention is not to be regarded as limited thereto.

EXAMPLE I

A hot gaseous stream (1,045,800#/hr.) at a temperature of 905° F. is passed through the heat exchanger 10 in indirect heat transfer relationship with a salt mixture (1,044,000#/hr) at a temperature of 600° F. to form a heated salt mixture at a temperature of 744° F. and a vent gas stream in line 18 at a temperature of 695° F. The heated salt mixture is passed through the heat exchanger 22 to 30 to heat fluid passed in indirect heat exchange, as set forth in Table I, below:

| Heat Exchanger | Feed | T (°F.) Inlet | T (°F.) Outlet | Quantity |
|---|---|---|---|---|
| 22 | L. P. Steam | 365 | 650 | 5000#/hr. |
| 24 | — | — | — | — |
| 26 | DOWTHERM A* | 650 | 700 | 2265 GPM |
| 28 | THERMINOL 66** | 450 | 500 | 2580 GPM |
| 30 | — | — | — | — |

*Registered Trademark of Dow Chemical Co., Inc.
**Registered Trademark of Monsanto Co.

There is no HP steam generated in heat exchanger 30 or superheated in heat exchanger 24 since the heat removed from the heat transfer salt mixture in the heat exchangers 22, 26 and 28 balance the heat added to the heat transfer salt mixture in heat exchanger 10.

While the invention has been described in connection with an exemplary embodiment thereof, it will be understood that many modifications will be apparent to those of ordinary skill in the art and that this application is intended to cover any adaptations or variations thereof. Therefore, it is manifestly intended that this invention be only limited by the claims and the equivalents thereof.

What is claimed is:

1. A heat recovery system for recovering the heat potential of a gaseous stream having a temperature of from 500° to 2500° F., which comprises:

a storage tank for a heat transfer salt mixture;

a primary heat exchanger means for passing said gaseous stream in indirect heat transfer relationship to said heat transfer salt mixture to recover said heat potential;

conduit means for passing said heat transfer salt mixture from said storage tank to said primary heat exchanger means;

a plurality of serially arrayed heat exchanger means for passing the heated heat transfer salt mixture in indirect heat transfer relationship with fluids at descending temperature levels for recovery of said heat potential, said plurality of heat exchangers means serially including a first heat exchanger for producing super heated low pressure steam, a second heat exchanger for producing super heated high pressure steams, a third heat exchanger for heating a secondary high temperature heat transfer oil, a fourth heat exchanger for heating a secondary low temperature heat transfer oil and a fifth heat exchanger for generating high pressure steam;

conduit means for passing said heated heat transfer salt mixture to said plurality of heat exchanger means from said primary heat exchanger means; and conduit means for passing said heat transfer salt mixture from said plurality of heat exchangers to said storage tank.

2. The heat recovery system as defined in claim 1 and further including conduit means for passing said high pressure steam from said fifth heat exchanger to said first heat exchanger for producing superheated high pressure steam.

3. The heat recovery system as defined in claim 1 and further including conduit means for by-passing said third heat exchanger for heating said secondary high temperature heat transfer oil.

4. The heat recovery system as defined in claim 1 and further including conduit means for by-passing said fourth heat exchanger for heating said secondary low temperature heat transfer oil.

5. The heat recovery system as defined in claim 1 and further including conduit means for by-passing said fifth heat exchanger for generating high pressure steam.

6. The heat recovery system as defined in claim 1 wherein said salt mixture is heated to a temperature of from 700° to 900° F.

7. The heat recovery system as defined in claim 1 where said fluids are heated to a temperature level of about 650° to 700° F., 640° to 690° F., 690° to 750° F., 490° to 500° F. and 470° to 400° F., respectively.

8. The heat recovery system as defined in claim 1 wherein at least one of said third, fourth or fifth heat exchangers is by-passed during passage of said heated salt mixture through said plurality of serially arrayed heat exchanger means.

9. The heat recovery system as defined in claim 8 wherein two of said heat exchangers are by-passed during passage of said heated salt mixture through said plurality of serially arrayed heat exchanger means.

* * * * *